United States Patent [19]

Peterson et al.

[11] 4,170,922

[45] Oct. 16, 1979

[54] IGNITOR

[75] Inventors: Gary L. Peterson; Larry L. Liedtke, both of Ridgecrest, Calif.

[73] Assignee: The United States of America as represented by the Secretary of the Navy, Washington, D.C.

[21] Appl. No.: 833,852

[22] Filed: Sep. 16, 1977

[51] Int. Cl.[2] ..... F41F 1/04; H01T 13/20

[52] U.S. Cl. ..... 89/7; 313/138; 313/139; 313/143

[58] Field of Search ..... 102/203, 28 R; 89/7; 313/138, 139, 143

[56] References Cited

U.S. PATENT DOCUMENTS

| | | | |
|---|---|---|---|
| 2,018,783 | 10/1935 | Graf | 313/138 X |
| 2,048,028 | 7/1936 | Rabezzana et al. | 313/143 X |
| 2,874,321 | 2/1959 | Summerer | 313/138 X |
| 2,918,871 | 12/1959 | Taylor | 102/203 |
| 2,941,106 | 6/1960 | Peras | 313/138 X |
| 2,972,951 | 2/1961 | Stresau | 102/203 |
| 2,986,090 | 5/1961 | Doerpinghaus | 102/28 R |
| 2,996,944 | 8/1961 | Chessin et al. | 102/28 R X |
| 3,019,732 | 2/1962 | Kaspaul | 102/28 R |
| 3,247,796 | 4/1966 | Kirshner | 102/46 |
| 3,295,446 | 1/1967 | Harnau | 102/28 R |
| 3,312,848 | 4/1967 | Baum | 313/139 X |
| 3,390,636 | 7/1968 | Perkins et al. | 102/28 R |
| 3,754,506 | 8/1973 | Parker | 102/28 R |
| 3,763,739 | 10/1973 | Tassie | 89/7 |
| 3,958,144 | 5/1976 | Franks | 313/138 |
| 4,085,653 | 4/1978 | Tassie et al. | 89/7 |

*Primary Examiner*—David H. Brown

*Attorney, Agent, or Firm*—R. S. Sciascia; W. Thom Skeer; T. W. Hennen

[57] ABSTRACT

An ignitor for a liquid propellant gun having a center electrode supported and surrounded by insulation so that only a planar or domed face is exposed. The assembly is firmly seated in the bolt nose of the gun and several outer electrode configurations with little or no precombustion area are disclosed.

13 Claims, 4 Drawing Figures

IGNITOR

BACKGROUND OF THE INVENTION

1. Field of the invention

This invention relates to spark ignitors and more particularly to spark ignitors for liquid propellant guns.

2. Description of the Prior Art

A liquid propellant gun (LPG) is one in which a liquid propellant is burned in a firing chamber to propel a projectile from the gun. Such a gun uses a simpler projectile feed, has a flatter combustion chamber time-pressure characteristic, and more flexible installation and rapid fire features than a conventional gun. The liquid propellant, which may be either a monopropellant, or a fuel and an oxidizer, bipropellant is injected into the bore of the chamber, which is defined on one end by the base of the projectile and on the other by a bolt which a flattened end, termed the bolt nose. The bolt slides forward to seal the injection ports and position the projectile. To fire the LPG, the propellant is ignited by a pyrotechnic, thermal or electrical ignitor.

Previous electrical ignitors employed a center electrode which was free standing and projected into a small precombustion chamber to facilitate propellant ignition. These ignitors are subject to the bending of the center electrode due to pressure in the gun chamber, on the order of 60 Kpsi (411,700 Pa). Prior art ignitors also develop very high electrode temperatures and require frequent replacement. Test results have shown that prior art ignitors are also dependent on electrical polarity.

SUMMARY OF THE INVENTION

A sturdy, reliable ignitor for liquid propellant guns is installed in a standard bolt nose with a tubular center electrode anchored in a seat in the bolt nose and surrounded by insulation. The center electrode does not extend beyond the insulation except that if a rounded rather than flat face is used, the rounded portion should extend beyond the insulation. An annular outer electrode surrounds the inner electrode and either does not extend beyond the inner electrode or extends in such a fashion as to openly communicate with the combustion chamber.

DESCRIPTION OF THE PREFERRED EMBODIMENTS

Figure 1:
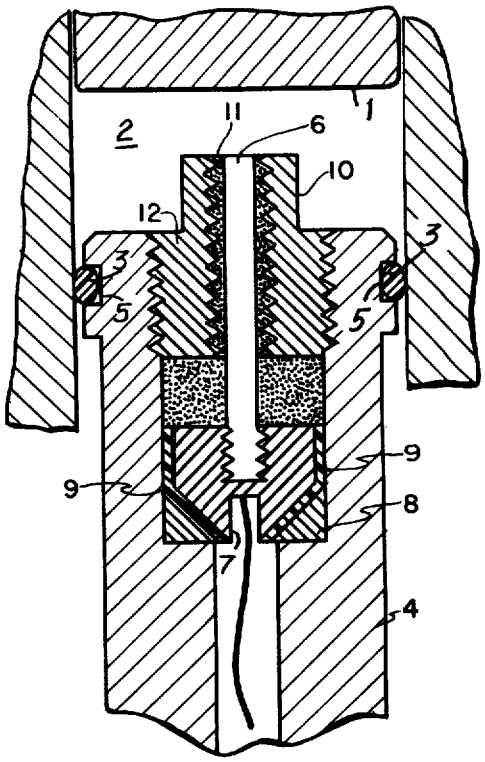
FIG. 1 is a cross section view taken along the longitudinal axis of an ignitor according to the present invention wherein the center and outer electrodes form a planar surface extending beyond the bolt nose.

Referring now to FIG. 1, the ignitor of the present invention is installed in the nose of a standard liquid propellant gun (LPG) bolt 4. Gun bolt 4 is provided with a groove 5 near the nose for an O-ring 3 which seals the bolt end of the combustion chamber. The combustion chamber of an LPG contains a bore 2 bounded on the barrel end of the gun by a projectile 1. The propellant is injected into the LPG chamber, the bolt slides forward and the propellant is ignited to propel the projectile.

The ignitor is thus in direct communication with the extreme temperature and pressure of the LPG chamber. To provide a sturdy ignitor, the center electrode 6 is threaded into a hard insulative seat 7, such as anodized aluminum, which rests on a copper seal 8 in an interior chamber of the bolt 4. Insulation between the seat 7 and the copper seal 8 is provided by the surface of the seat 7 and by a dielectric 9 which is preferably a shock-resistant material and preferably TEFLON ® tape. The outer electrode 10 is insulated from the rodlike portion of the inner electrode 6 by a shock-resistant insulator 11 such as TEFLON ®. TEFLON ®, polytetrafluoroethylene is a preferred insulator due to its relatively high strength, dielectric constant, thermal properties and resistance to acids such as nitric acid, commonly found in LPG oxidizers. It also is somewhat elastomeric and provides shock absorption, although it may tend to extrude from the assembly. Glass-filled TEFLON ® is therefore preferred to prevent extrusion. Insulator 11 has a base portion which rests on seat 7 and an elongted portion which extends along the length of and surrounds the center electrode 6. The elongated portion is provided with threads on its outer surface which mate with outer electrode 10. Outer electrode 10 has its outer surface threaded to match threads on the chamber in bolt 4 and its inner surface is threaded to receive insulator 11. When the insulator 11 is TEFLON ®, the threads in the inner surface of electrode 10 and on the insulator 11 help to secure the insulator and prevent extrusion during gun firing. Insulator 11 is loaded to about 40,000 psi (277,800 kPa) when the outer electrode is threaded into the assembly to seal the ignitor.

The outer electrode 10 thus surrounds the inner electrode 6 and is separated therefrom by the thickness of insulator 11. A center portion 12 of the outer electrode 10 extends, with insulator 11 and center electrode 6, slightly into the chamber (about 7 mm on a 30 mm LPG) to form a flush face surface consisting of the extended center portion 12 of outer electrode 10, insulator 11 and the flat end of center electrode 6.

The spark must therefore travel between inner electrode 6 and outer electrode 10 across a flush face. Field plots of constant voltage lines show high current densities between the electrodes in a flush face design. This shows a distorted electrical field effect which actually produces a single filament arc at lower voltages than free-standing electrode ignitors.

Using a solid state, silicon controlled rectifier, ignition circuit such as is described by the inventors in U.S. Pat. No. 4,104,920 filed 10 Feb. 1977, and hereby incorporated into the present specification, the ignitors described herein will fire at 50 volts whereas 700 volts have been required to fire other ignitors. As much as 3,000 volts may be used with the ignitors of the present invention although lower voltages are desirable, for example, in aircraft application. Twelve hundred to thirteen hundred volts is the preferred voltage range (compared to 1600 v with prior designs) and about 36–42 J is the preferred energy range at the electrodes. The use of higher energies, however, permits the use of the present ignitors with monopropellants which are generally more difficult to ignite than bipropellants wherein the fuel and oxidizer are separately injected into the LPG chamber.

A number of design alternatives to the ignition as shown in FIG. 1 are possible. The flush face need not be extended into the chamber although this provides superior conduction by the propellant of the ignition and provides an ullage because the projectile is not flush against the bolt nose during propellant injection. The center electrode 6 and seat 7, rather than being threaded into each other, may be machined out of a single piece of stainless steel.

As stated, TEFLON® is a preferred dielectric. However, ceramics, anodized aluminum wherein the aluminum oxide surface provides the insulation, or other plastics may be used for insulation. From a purely structural standpoint, sapphire is the preferred dielectric. Ceramics and sapphire possess desirable heat transfer and structural properties so as to be equivalent for purposes of the present invention. For conductive members stainless steel is preferred. A pyrophoric material, such as tungsten, which blasts off small pieces during firing is also preferred for the center electrode, as this property aids in complete propellant ignition.

The present invention lacks a precombustion chamber, provides a sufficiently stable spark to cause ignition within the main volume of propellant, and eliminates compression problems of precombustors.

Figure 2:
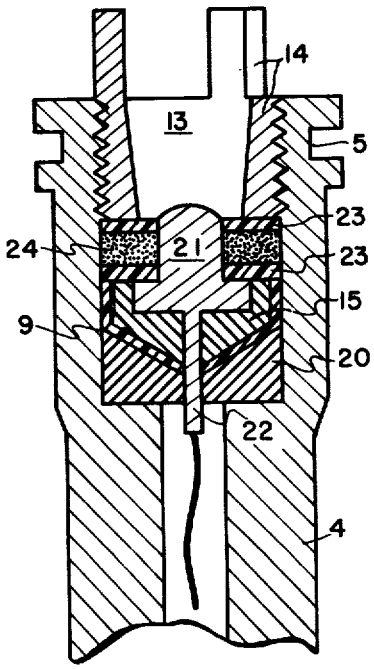
FIG. 2 is a cross section view taken along the longitudinal axis of an ignitor according to the present invention wherein the face of the center electrode is domed and slightly recessed in the bolt nose.

The embodiment of FIG. 2 retains a form of precombustor area 13. The outer electrode 14, rather than residing in a flush bolt face, presents a flush face with the insulator which is recessed into the bolt nose.

This embodiment, as shown in FIG. 2, uses a seat 15, insulation 9, and seal 20 similar to the extended flush face arrangement of FIG. 1. However, center electrode 21 presents a flush face with the insulator which is recessed into a chamber in the bolt nose.

The center electrode 21 has a rearward extension 22 for electrical connection through the bolt 4. The extension 22 is surrounded by a coaxial insulator for electrical insulation. The center electrode 21 has a base region for support in seat 15 and a domefaced cylindrical portion which is insulated by three dielectric rings. The outer dielectric rings 23 are preferably glass filled TEFLON® and sandwich a center ring 24 of Coors ceramic. The dielectric rings 23 or 24 abut the base region of the center electrode 21 and extend along the cylindrical portion so that only the domed face of the electrode is exposed in the precombustion area 13, whose sides are formed by outer electrode 14, which is threaded into the bolt nose to press on the ceramic discs and parts below. The ceramic discs should be machined to close tolerances to insure structural integrity of the ignitors. Beyond the bolt nose, three arms of the center electrode 14, two shown, project to reduce turbulence and allow free flow of the main porpellant charge. The propellant is enclosed only in the small area in the interior of the bolt nose and the cylindrical portion of the center electrode 21 is supported along its entire length by the insulating rings.

Figure 3B:
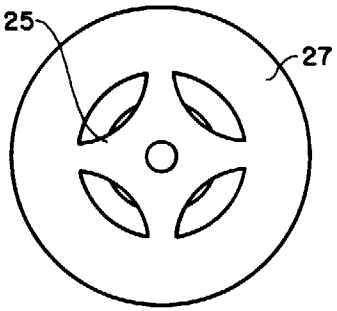
FIG. 3*b* is an end view of the ignitor of FIG. 3*a* showing the webbed face of the outer electrode.
Figure 3A:
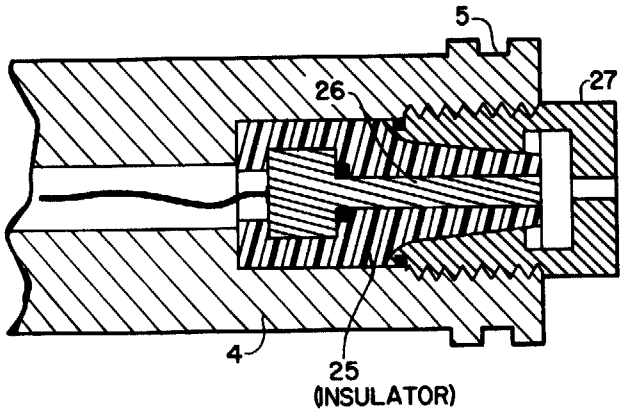
FIG. 3*a* is a cross section view taken along the longitudinal axis of an ignitor according to the present invention wherein the center electrode is on a plane with the bolt nose and the outer electrode extends slightly beyond the bolt nose.

Referring now to FIG. 3, a further variation of the present invention has a tapered insulator 25 supporting the entire length of a center electrode 26 which is flush with the bolt nose. The outer electrode 27 however, extends beyond the bolt nose about 7 mm in a 30 mm LPG to form a small precombustor area and is capped, as shown in FIG. **3*b***, by a flat web which permits communication with the main propellant charge. The arc forms between the center electrode and the center of the web. Sharp edges and the small gap between the tip of the center electrode and the center of the web produce a distorted field effect which permits a low voltage spark.

In all of the foregoing embodiments, the center electrode may be positive or negative. In previous ignitors, significantly higher voltages were necessary if the center electrode was positive. The diameter of the center electrode, while not critical, is about 0.32 cm (⅛ inch) in a 30 mm LPG.

Voltage, electrode surface area, sharp edges and gap size may all be adjusted to yield the desired spark characteristics. The ignitors of the present invention having a flush face could be adapted for use in binary bombs, fuel-air explosives or the like.

What is claimed is:

1. An ignitor for a liquid propellant gun having a bore comprising:

a bolt having a nose;

a center electrode having a rodlike portion, a domed end and a broadened end anchored in said bolt at said broadened end;

ring means for insulating said center electrode, surrounding and abutting the rodlike portion of the center electrode so that only the domed end is exposed to said bore;

an outer electrode having a threaded portion anchored at one end in the bolt, abutting said ring means and surrounding said domed end of said electrode, said threaded portion extending beyond said domed end but not beyond said bolt nose; and means for transmitting electrical energy to said center electrode and connected thereto so as to cause a spark between said center and outer electrodes.

2. The ignitor of claim 1 wherein said ring means comprises a ceramic ring and a glass-filled polytetrafluoroethylene ring.

3. The ignitor of claim 1 wherein the outer electrode includes a plurality of arms extending beyond said bolt nose.

4. The ignitor of claim 1 wherein said ring means includes a ceramic ring.

5. The ignitor of claim 1 wherein said transmitting means includes an integral cylinderical extention of said center electrode extending away from said bolt nose.

6. The ignitor of claim 1 wherein said ring means includes two glass-filled polytetrafluoroethylene rings on either side of a ceramic ring.

7. An ignitor according to claim 1 wherein said domed and of said center electrode extends outwardly toward said bolt nose.

8. The ignitor of claim 1 further comprising an insulated seat for supporting said center electrode at the broadened end.

9. The ignitor of claim 8 wherein said outer electrode further comprises a plurality of arms extending beyond said bolt nose.

10. An ignitor according to claim 1 wherein said center electrode is recessed in a precombustion area having sides which are portions of said outer electrode.

11. An ignitor according to claim 10 wherein said domed end of the aforesaid center electrode extends in an outwardly convex fashion.

12. An ignitor according to claim 11 wherien the aforesaid outer electrode is configured to have a plurality of arms extending outwardly beyond said bolt nose.

13. An ignitor according to claim 11 wherein the aforesaid bolt has a circumfrential groove dimensioned to support an O-ring.

* * * * *